United States Patent [19]

Perrin

[11] 4,130,228

[45] Dec. 19, 1978

[54] FILM DISPENSING CONTAINER

[75] Inventor: Ronald Perrin, Marshall, Mich.

[73] Assignee: The St. Regis Paper Company, New York, N.Y.

[21] Appl. No.: 852,057

[22] Filed: Nov. 16, 1977

[51] Int. Cl.[2] ..... B26F 3/02

[52] U.S. Cl. ..... 225/19; 225/43; 225/49; 229/175

[58] Field of Search ..... 225/19, 20, 43, 48–50; 229/175

[56] References Cited

U.S. PATENT DOCUMENTS

| | | | |
|---|---|---|---|
| 2,226,477 | 12/1940 | Moore | 225/48 X |
| 3,229,876 | 1/1966 | Osborn, Jr. | 225/49 |
| 3,281,036 | 10/1966 | Woodling | 225/49 |
| 3,722,767 | 3/1973 | Struble | 225/49 |
| 3,851,809 | 12/1974 | McKibbin | 225/20 |

*Primary Examiner*—Frank T. Yost

[57] ABSTRACT

A container for dispensing increments of tearable film from a roll of the film in the container, having a cutting edge on a portion of the cover, and so arranged that during shipping and storage of the container holding the film, the portion of the cover with the cutting edge is tucked within the box and thereby enhancing safety and protection of the cutting edge and that upon the film being dispensed the said portion of the cover with the cutting edge is moved outwardly of the box to expose the cutting edge and to position it for cutting increments of film from the roll of film.

7 Claims, 7 Drawing Figures

FILM DISPENSING CONTAINER

My invention is directed to a container for dispensing from a roll of film contained in the container successive increments of the film severed from the roll of film as such increments are desired.

By the use of the term "film" herein, I am referring to long thin sheets rolled into cylindrical form, of pliofilm, cellophane, other plastic thin bendable material, metallic film, paper products, and like material which is capable of being severed or cut by being pulled against the resistance of a cutting edge provided upon the container.

In film dispensing containers the problem has previously existed that the cutting edge was to a great degree exposed and unprotected whereby there was a danger of the person handling the container during shipping and storage being cut and injured and also a risk of the cutting edge becoming damaged or distorted during shipping and storage of the container.

My improved dispensing container obviates the former dangers, risks and shortcomings of the previously known film dispensing containers.

An object of my invention is to provide a more efficient dispensing container which limits or eliminates the exposure of such dangers and risks.

Another object is the provision of an improved film dispensing container which is economical to manufacture and which readily lends itself to an efficient manufacturing process.

Other objects and a fuller understanding of this invention may be had by referring to the following description and claims, taken in conjunction with the accompanying drawings in which:

Figure 6:
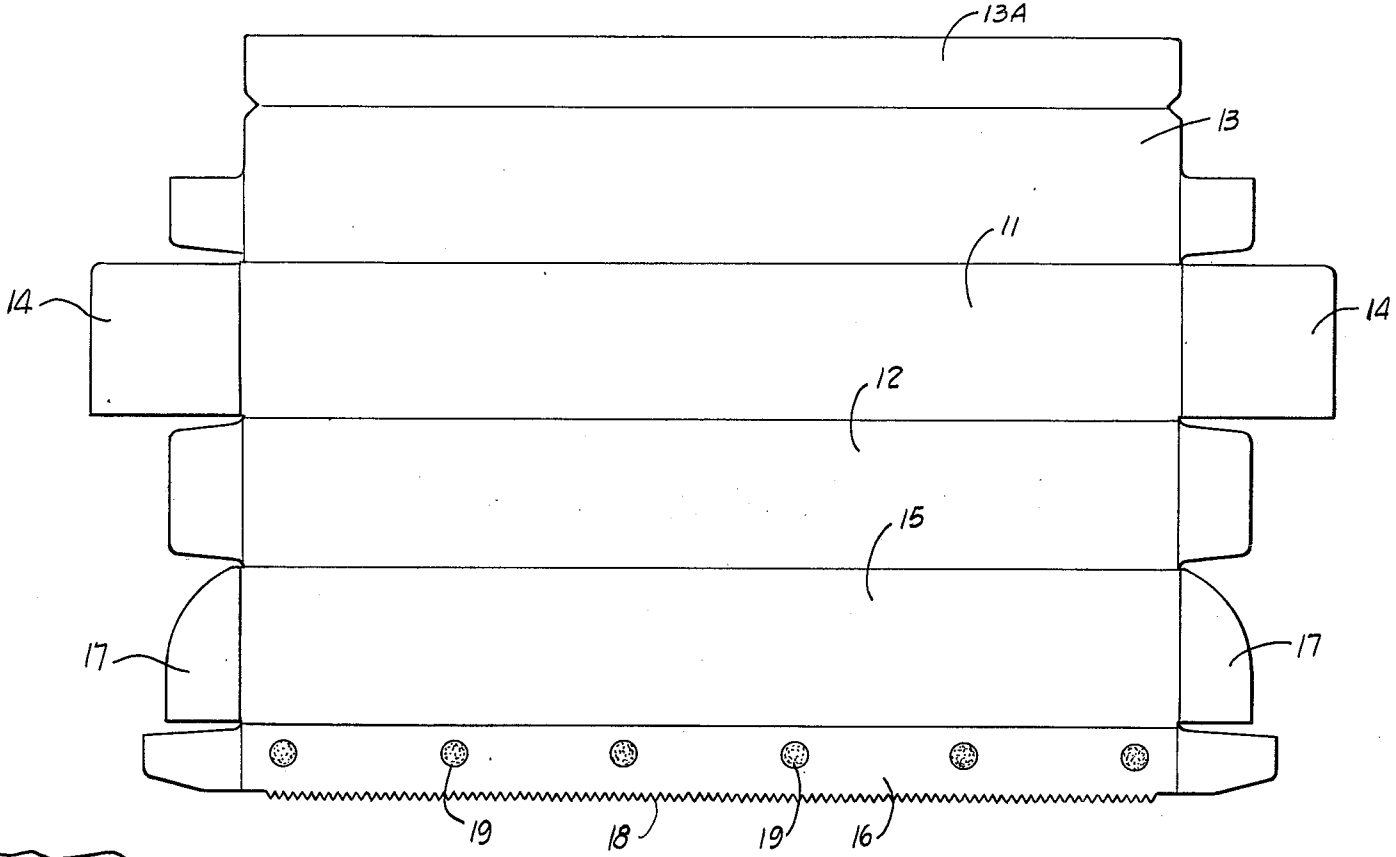
Figure 7:
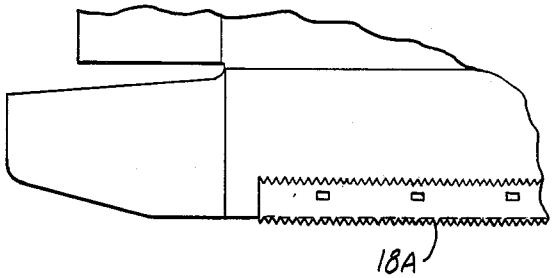

FIG. 6 is a plan view of the blank of paperboard cut from stock and from which the container is made by suitable folding and gluing together of the parts. The six glue spots 19 which adhere the front portion of the cover to the front wall of the container are indicated as stippled circles; and FIG. 7 is a fragmentary view of a modified version of my container wherein the cutting edge is provided by a serrated metal strip secured to the front portion of the cover.

As shown in the drawings, my dispenser in its preferred form comprises a cardboard box with a cover integral therewith, the box being adapted to contain a roll of film therein and constructed for the severing of successive increments of film from the roll as such increments are desired The box is of elongated shape with a rectangular cross-section to accommodate a roll of film therein. It comprises a bottom wall 11, a back wall 12, a front wall 13, end walls 14 at its opposite ends, and a cover 15 hingedly connected to the upper edge of the back wall 12. The front wall 13 is folded over as shown to provide additional strength and rigidity. The folded over portion 13A is suitably adhered such as with glue to the main part of the front wall 13.

The cover 15 has a front depending portion 16 extending downwardly from and along the front edge of the main body of the cover 15. The cover 15 also has end portions 17 extending downwardly at the opposite ends of the cover. The front portion 16 of the cover 15 and the end portions 17 of the cover are joined so as to move with the cover 15 all as a unit upon the cover being hingedly swung along an axis coinciding with the juncture of the cover 15 and the back wall 12.

Figure 1:
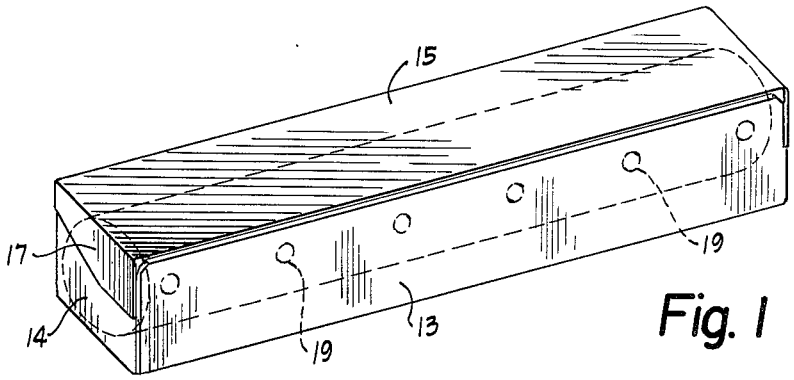
FIG. 1 is a perspective view of my improved container in its original closed position of the parts prior to opening of the container. The glue spots 19 adhere the cover down in position behind the front wall.
Figure 2:
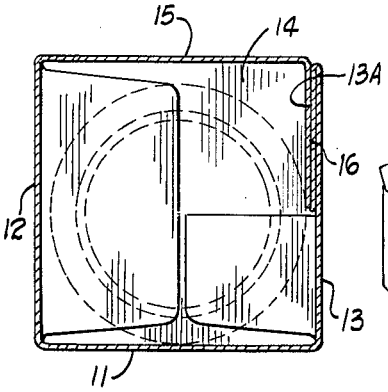
FIG. 2 is a cross-sectional view of the container in its originally closed position shown in FIG. 1.
Figure 3:
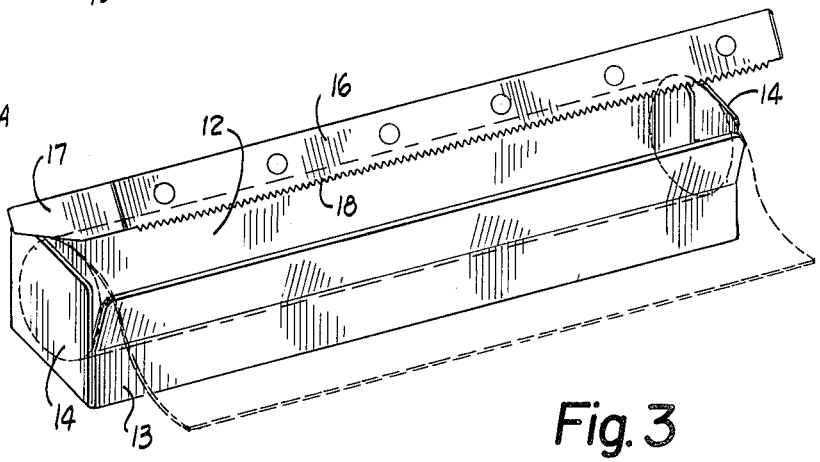
FIG. 3 is a perspective view of my improved container opened up to provide access to the roll of film therein, the places where the cover had been glued and torn from the front wall appearing as circles.

The cover 15 along with front depending portion 16 and end portions 17 are adapted to be in two positions. During shipping and storage of the container with a roll of film 20 therein, the cover is positioned such as illustrated in FIGS. 1 and 2, the front depending portion 16 is tucked within the container. A cutting edge portion 18 extending along the bottom or free edge of the portion 16 is then protected and not exposed. In this position, the cutting edge portion 18 is protected from damage and persons handling the container are not exposed to risk of being cut or injured on the cutting edge portion 18.

Glue spots 19 at separated locations along the length of the container adhere the front portion of the cover to the front wall of the box. The adherence provided by the glue spots may be readily overcome by flexing the front wall 13 of the box outwardly from the front portion 16 of the cover sufficiently to break the adhesion. The front wall 13 is sufficiently yieldable to permit such flexing.

To accommodate the movement of the front portion 16 of the cover to within the container and tucked in behind the front wall 13 of the box, while permitting the end portions 17 of the cover to remain on the outside of the box, slits 21 are provided at the opposite ends of the box. These slits 21 are located at the junctures, respectively, of the front wall 13 of the box and the end walls 14 of the box. By reason of slits 21, the front portion 16 of the cover may be tucked into the box behind the front wall of the box, such as in the position illustrated in FIGS. 1 and 2.

Figure 4:
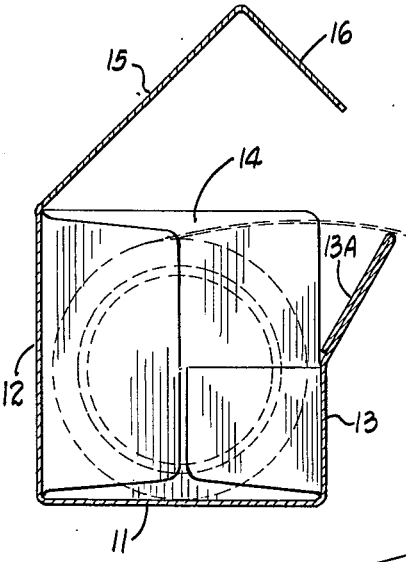
FIG. 4 is a cross-sectional view of the container in the position shown in FIG. 3 wherein the cover has been lifted to provide access to the film within the container.
Figure 5:
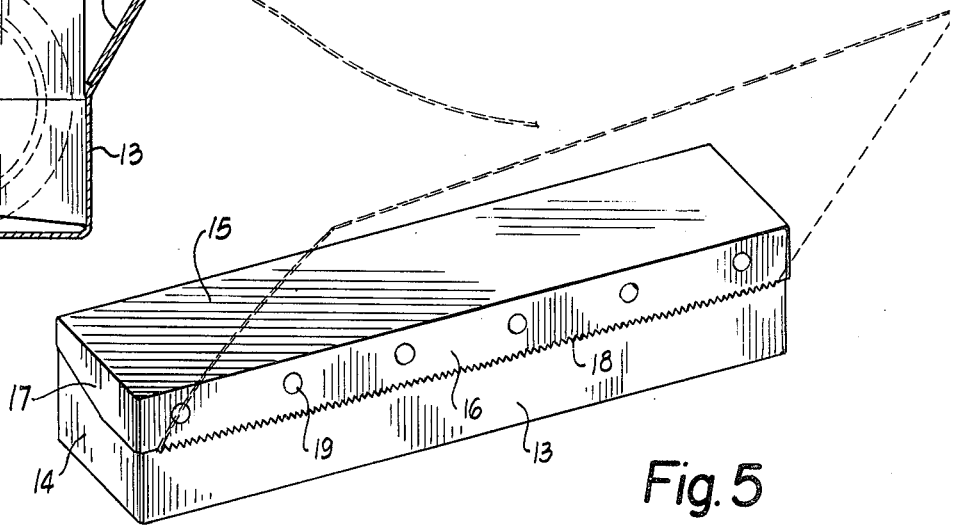
FIG. 5 is a perspective view of my improved container in its dispensing position after the cover has been moved downwardly from its position shown in FIGS. 3 and 4 to close the container with the front portion of the cover carrying the cutting edge positioned outwardly of the front wall of the container as distinct from its original position.

The other position of my improved container is the position of the parts when it is desired to dispense increments of film from the roll of film in the container. For putting the parts of the container in this latter position, the adherence provided by glue spots 19 is physically overcome and the cover is swung sufficiently upward so that the front portion 16 of the cover 15 clears the front wall 13 of the box. The front portion 16 of the cover is then moved downwardly to where the top of the cover 15 is in a plane parallel to the bottom wall 11 and the front portion 16 is located outside of and closely adjacent to the outer surface of the front wall of the box. During this operation, the film is also unrolled and the film is threaded over the top edge of front wall 13 of the box and then downwardly through a space or crack between the front wall 13 of the box and the front portion 16 of the cover to where it engages the then exposed cutting edge portion 18 on the lower edge of front portion 16 of the cover. This operating position is illustrated for example in FIG. 4. The section of film unrolled from the roll and extending outwardly from the container in position to be severed by the cutting edge portion 18 is indicated by the reference character 22.

To provide rigidity and strength to the front wall 13 of the box it may be folded back on itself to have a double thickness as illustrated along the upper region of the front wall 13. The folded back portion 13A is adhered such as by glue to the main part of wall 13.

The cutting edge portion 18 is preferably serrated to aid in severing the film being pulled against it. This serrated edge portion 18 shown in the preferred form of the invention is treated or coated with a suitable plastic to provide rigidity and strength to the same, and to assure sharp points on the serrations.

The cutting edge portion 18 may instead be provided with a serrated metal strip 18A which is secured to the cardboard in any suitable manner such as by staking upset portions of the strip to the cardboard. This metal strip 18A is illustrated in FIG. 7.

The blank in the flat of the container in its preferred form is illustrated in FIG. 6. The usual tab ends which are at the ends of the blank are folded over to provide the end walls 14 of the box and the end portions 17 of the cover. The gluing of the tab ends to form the end walls 14 and end portions 17 are done as is known in the industry.

The roll of film 20 is loaded into the container from an open end thereof in the operation of loading and then closing the open end in a manner well known in the art.

My improved container fills a need for a safe film dispensing container, economical to manufacture and efficient to use.

The present disclosure includes that contained in the appended claims, as well as that of the foregoing description.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A dispensing container for a roll of film and adapted for the dispensing of successive increments of said film from the container, comprising the combination of an elongated cardboard box of rectangular cross-section formed for containing a roll of film, said box having a rear wall, a bottom wall, a front wall, and end walls, said box having a cover portion extending longitudinally of the box hingedly connected to the upper edge of the rear wall of the box, said cover portion at its ends having depending end portions extending downwardly adjacent and outwardly of the upper regions of said end walls, respectively, to overlap the same, said cover along its front edge having a depending front portion extending downwardly adjacent the front wall to overlap the same, said front portion of the cover, when the container is in non-dispensing condition, being tucked within the box behind the front wall of the box and adjacent thereto, said box at the juncture of said front wall and said end walls, respectively, having slits formed therein for permitting said front portion of the cover to be moved to within the box behind the front wall of the box, said front portion of the cover when tucked within the box and the front wall of the box being initially adhered together for holding the box closed during shipping and storage of the box with the roll of film therein, said front portion of the cover being separable from said front wall of the box by overcoming the said initial adherence of the front portion of the cover to the front wall of the box, said front portion of the cover after separation from the front wall of the box upon swinging of the cover upwardly from the front wall being movable to a position outwardly of, and adjacent to, the front wall of the box, said front portion of the cover having a lower cutting edge extending therealong whereby film in the box, being successively unrolled and threaded over the top edge of the front wall of the box and hence downwardly between the front portion of the cover and the front wall of the box, may engage said cutting edge, the film being severable into successive increments by the film extending from between the front wall of the box and the front portion of the cover being manually pulled downwardly from the box a distance fixing the amount of increment to be dispensed and hence pulled upwardly from the box against the resistance of said cutting edge to tear the film along a line coinciding with said cutting edge to dispense such increment of film from the box.

2. A dispensing container as claimed in claim 1 and in which said cutting edge is serrated.

3. A dispensing container as claimed in claim 2 and in which said serrated cutting edge is provided by a serrated metal strip secured to the front portion of the cover extending along the lower edge portion thereof.

4. A dispensing container as claimed in claim 2 and in which said serrated cutting edge is provided by a hard plastic adhered to the edge portion of the front portion of the cover and extending therealong to add strength and rigidity to the cutting edge.

5. A dispensing container as claimed in claim 1 in which said front wall of the box is doubled back on itself along the upper edge portion thereof to provide double thickness for added strength and rigidity therealong.

6. A dispensing container as claimed in claim 1 and in which the front portion of the cover and the front wall of the box are initially adhered together by separated spots of glue spaced longitudinally of the box.

7. A dispensing container as claimed in claim 1 in which the front portion of the cover extends downwardly from the cover adjacent the front wall of the box a distance less than the depth of the box from the cover to the bottom wall of the box, in which the depending edge portions of the cover extend downwardly from the cover a distance less than the depth of the box from the cover to the bottom wall of the box, and in which said slits at the juncture of said front wall and said end walls extending downwardly a distance to accommodate the front portion of the cover when tucked within the box.

* * * * *